US006845843B2

(12) United States Patent
Svendsen et al.

(10) Patent No.: US 6,845,843 B2
(45) Date of Patent: Jan. 25, 2005

(54) SUCTION MUFFLER FOR A REFRIGERATING MACHINE

(75) Inventors: Christian Svendsen, Krusaa (DK); Jens Erik Nissen, Graasten (DK); Morten Svendsen, Rødekro (DK)

(73) Assignee: Danfoss Compressor GmbH, Flensburg (DE)

( * ) Notice: Subject to any disclaimer, the term of this patent is extended or adjusted under 35 U.S.C. 154(b) by 0 days.

(21) Appl. No.: 10/345,508

(22) Filed: Jan. 16, 2003

(65) Prior Publication Data

US 2003/0150670 A1 Aug. 14, 2003

(30) Foreign Application Priority Data

Feb. 9, 2002 (DE) ..... 102 05 487

(51) Int. Cl.[7] ..... F01N 1/14
(52) U.S. Cl. ..... 181/262; 181/212; 181/259
(58) Field of Search ..... 181/262, 212, 181/259, 260, 261, 232, 226, 221, 220, 215

(56) References Cited

U.S. PATENT DOCUMENTS 5,734,134 A * 3/1998 Park ..... 181/229
6,358,019 B1 3/2002 Iversen et al.

FOREIGN PATENT DOCUMENTS

DE 3645083 8/1991

* cited by examiner

*Primary Examiner*—Kimberly Lockett
(74) *Attorney, Agent, or Firm*—McCormick, Paulding & Huber LLP

(57) ABSTRACT

The invention concerns a suction muffler for a refrigerating machine with a housing, in which at least one chamber is arranged and which has an inlet opening (7), an outlet opening and an oil discharge opening.

It is endeavoured to avoid that too much oil remains in the chamber.
For this purpose, an oil collecting room is arranged to be connected to the bottom end of the chamber, the oil discharge opening being arranged at the bottom end of said oil collecting room.

13 Claims, 3 Drawing Sheets

SUCTION MUFFLER FOR A REFRIGERATING MACHINE

CROSS-REFERENCE TO RELATED APPLICATION

This application is entitled to the benefit of and incorporates by reference essential subject matter disclosed in German Patent Application No. 102 05 487.8 filed on Feb. 9, 2002.

FIELD OF THE INVENTION

The invention concerns a suction muffler for a refrigerating machine with a housing, in which at least one chamber is arranged and which has an inlet opening, an outlet opening and an oil discharge opening.

BACKGROUND OF THE INVENTION

A suction muffler of this kind is known from DE 36 45 083 C2. It is particularly applied in connection with small, enclosed refrigerating machines, as used in the domestic area for refrigerators and freezers. The refrigerant gas sucked in through the suction muffler always contains an amount of oil, part of which precipitates inside the muffler. This oil gathers in the chamber. At the bottom of the chamber an oil discharge opening is provided, through which the precipitated oil can run out of the chamber. However, this oil discharge opening can also create an acoustic coupling between the chamber and the environment of the suction muffler. In the known case, a tube is provided, which is connected to the oil discharge opening. This tube can be dimensioned so that an acoustic coupling is created, which ensures a sufficient suppression of the interfering frequencies. Depending on the pressures during operation, more or less oil will gather in the tube, sticking to its walls.

In such suction mufflers, the problem is that the oil from the refrigerant flow settling in the chamber cannot immediately flow to the oil sump during operation of the compressor. Exceptions occur when, for example, the inlet opening is arranged at the deepest spot of the chamber, which, however, cannot usually be assumed. Particularly critical is the situation, when the refrigerant is led direct from the inlet pipe connector of a compressor housing to the suction muffler, as in this case much oil is contained in the refrigerant flow. As long as the compressor of the refrigerating machine is in operation, the pressure inside the chamber is somewhat lower than that outside the housing, as refrigerant gas is currently sucked off from the chamber. This pressure difference naturally also acts upon the oil outlet opening, that is, counteracts the discharge of the oil from the chamber. Not until the compressor is disconnected, is the pressure equalised, thereby allowing the oil gathered in the chamber can flow off at the bottom by means of gravity. With a long and uninterrupted operation period, a considerable amount of oil can gather in the chamber, which causes several disadvantages. Firstly, oil, which is required for lubrication and cooling, is taken away from the compressor. Secondly, the volume of the chamber available for muffling is reduced. Most important, however, is that the more oil is gathered in the chamber, the larger is the amount of oil, which is carried along by the refrigerant, the so-called external oil circulation. This oil in the refrigerant circuit is undesirable, as the oil will reduce the heat transfer in the heat exchangers of the circuit. When too much oil is contained in the refrigerant flow, the risk of a fluid stroke in the compressor exists, when too much oil is sucked into the cylinder of the compressor.

The invention is based on the task of avoiding the situation where too much oil remains in the chamber.

SUMMARY OF THE INVENTION

With a suction muffler as mentioned in the introduction, this task is solved in that the housing comprises an oil collecting room connected with the bottom end of the chamber, an oil discharge opening being arranged at the bottom end of the oil collecting room.

With this embodiment, it is possible for the oil to escape from the chamber into the oil collecting room. Thus, the complete volume of the chamber is available for the muffling of noise. A fluid column can thus be created in the oil collecting room. The hydrostatic pressure at the bottom end of the fluid column counteracts the pressure difference between the chamber and the environment of the housing. As soon as the fluid column has reached a certain height, oil can escape from the oil collecting room during the operation of the compressor. Thus, it is avoided that the chamber is filled with oil. Additionally, it is ensured that the fluid column of the discharged oil provides an acoustic decoupling between the chamber and the environment of the housing.

Preferably, the oil collecting room has a base surface, which is smaller than a base surface defined by the chamber. When designing the oil collecting room, it is not critical to provide the largest possible volume. It is important, however, that the oil can build up a fluid column, whose hydrostatic pressure is large enough to permit the oil to escape through the oil discharge opening during operation, even when a certain underpressure rules in the chamber in relation to the environment of the housing. This can also be achieved when the oil collecting room has a relatively small base surface.

Preferably, the oil collecting room is arranged in a housing nozzle projecting from the bottom side of the housing. Thus, the material consumption for the housing is kept small. Only little additional material is required for the housing nozzle. This makes the manufacturing cheaper.

Preferably, the housing nozzle has an oblong cross-section. In other words, the length of the cross-section face of the nozzle is larger than the width, the longitudinal direction of the cross-section corresponding to the longitudinal direction of the cross-section of the chamber. The housing of the suction muffler is made to be relatively flat, among other things for space reasons. Together with a compressor, the suction muffler must be accommodated in a shell. The correspondingly flat embodiment of the housing nozzle ensures firstly that the housing nozzle does not project sideward from the housing. Secondly, the housing nozzle gets a sufficient mechanical stability.

Preferably, the oil discharge opening ends in an oil-filled area. Thus, it is ensured that also during standstill phases a complete discharge of the oil from the oil collecting room is not possible. On the contrary, a small amount of oil remains in the oil collecting room, whose level corresponds to the level outside the housing nozzle. Thus, the acoustic coupling through the oil discharge opening is constantly prevented, also during the start of the compressor after a long standstill phase. In fact, the housing nozzle acts as a siphon.

Preferably, the oil discharge opening has a throttling resistance, which is larger than a throttling resistance generated by the oil collecting room. Through the oil collecting room the oil can flow relatively unpreventedly downward, that is, the oil collecting room creates no significant resistance for the oil, even though it is made as a channel. The amount of oil flowing through the oil collecting room is too small for this. With the oil discharge opening, it is different. It must not be dimensioned too large, in order to avoid an acoustic coupling between the chamber and the environment of the housing. Thus, the oil discharge opening meets the discharging oil with a certain resistance. The resistance conditions have been chosen so that the main throttling or at least the major share of the throttling of the discharging oil takes place in the oil discharge opening itself.

It is particularly preferred that the cross-section of the oil discharge opening amounts to 5% or less of the base surface of the oil collecting room. Thus, the oil discharge opening can be chosen relatively small. When the compressor is turned on, a negative pressure occurs in the chamber, through which gas bubbles, if any, can penetrate into the oil collecting room through the oil discharge opening. Because of the small cross-section of the oil discharge opening, the bubbles remain small in relation to the cross-section of the oil collecting room. Thus, they cannot prevent the creation of the fluid column.

Preferably, an insert is arranged in the housing, said insert dividing the chamber into an upper chamber and a lower chamber and having its own oil collecting room at the bottom end of the upper chamber, the oil discharge opening of said oil collecting room ending in the lower chamber. This gives the same effect as the oil collecting room at the bottom end of the lower chamber, that is, the oil can discharge from the upper chamber and reach the lower chamber via the oil discharge opening. A pressure difference between the upper chamber and the lower chamber is equalised by the hydrostatic pressure at the bottom end of the fluid column, which is created in the oil collecting room of the upper chamber.

It is preferred that the insert has a pipe-like insert nozzle, in which the oil collecting room is arranged, and which extends into the lower chamber. This ensures that a fluid column can also be created relatively fast even when a small oil volume is present. The use of the insert nozzle causes that the oil collecting room of the upper chamber also has a relatively small cross-section. This embodiment has the advantage that only a small volume of the lower chamber is occupied and that only a relatively small oil surface is available, from which oil can be entrained. This keeps the internal oil circulation small.

Preferably, the bottom end of the insert nozzle is surrounded by an annular wall, which is connected with the bottom of the lower chamber. Thus, a siphon is created, which prevents the oil from discharging completely from the oil collecting room of the upper chamber. This means that the oil discharge opening of the upper chamber is permanently filled with oil, so that an acoustic coupling between the upper chamber and the lower chamber through the oil discharge opening of the upper chamber can be effectively prevented.

Preferably, the insert nozzle has at least one rib on its outer wall, said rib extending substantially in the longitudinal direction. This gives a mechanical reinforcement of the insert nozzle, which keeps the oscillation possibilities of the nozzle small. Thus, additional noises are effectively avoided.

Preferably, a dividing wall is arranged in the oil collecting room. The dividing wall, which connects two side walls of the oil collecting room, forms an additional mechanical reinforcement and thus a strengthening of the housing nozzle, which has a positive influence on the oscillation behaviour of the muffler.

Preferably, the dividing wall projects into the chamber. Thus, the side walls of the housing, which limit the chamber, are connected with each other and strengthened. A noise generation caused by oscillations of the housing walls is thus reduced.

BRIEF DESCRIPTION OF THE DRAWING

In the following, the invention is described in detail on the basis of preferred embodiments in connection with the drawings, showing.

DETAILED DESCRIPTION OF THE PREFERRED EMBODIMENT

Figure 1:
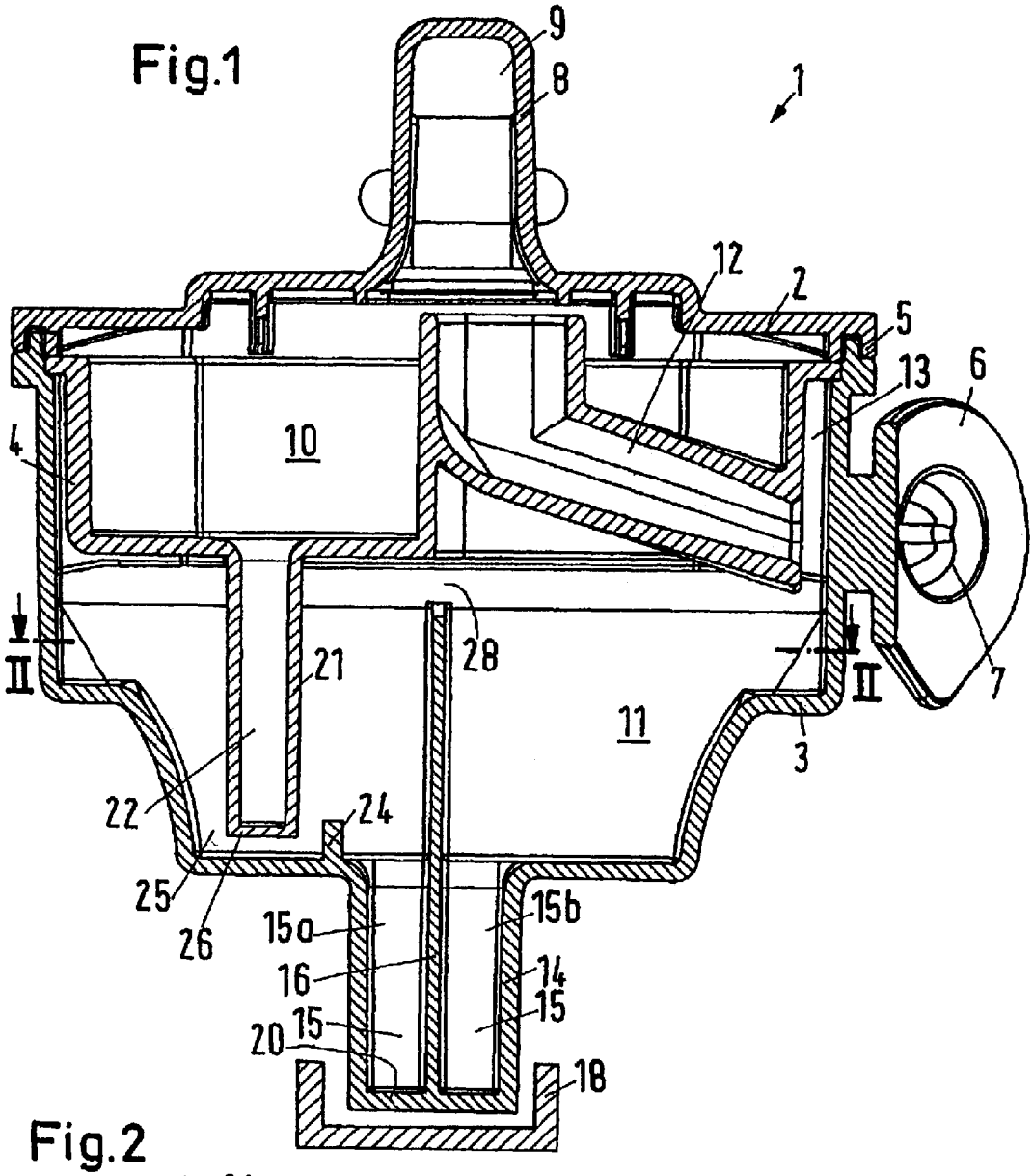
FIG. 1 is a longitudinal section I—I through a suction muffler according to FIG. 2.

A suction muffler 1 has a housing with an upper part 2, a lower part 3 and an insert 4. Upper part 2, lower part 3 and insert 4 are made of a plastic material and are connected with each other in the area of a connecting joint 5 by means of bonding or welding.

The lower part 3 has an inlet nozzle 6 with an inlet opening 7. In the upper part 2 is formed an outlet nozzle 8 with an outlet opening 9. The insert 4 divides the housing into an upper chamber 10 and a lower chamber 11. The two chambers 10, 11 are connected with each other via a channel 12, which is formed in the insert 4. The channel 12 is arranged next to an end of the inlet opening 7, a slot 13 being provided between the inlet opening 7 and the end of the channel, said slot being connected with the lower chamber 11.

The lower part 3 has at its lower end a housing nozzle 14, which extends downward from the bottom side of the lower part 3. All statements refer to the gravity direction. In the housing nozzle 14 is formed an oil collecting room 15, which is divided into two parts 15*a*, 15*b* by a separating wall 16. As can be seen from FIG. 2, two oil discharge openings 17*a*, 17*b* are arranged at the bottom of the oil collecting room 15. Due to the position of the section in FIG. 1, these cannot be seen there. Through the oil discharge openings 17*a*, 17*b*, oil that has gathered in the oil collecting room 15 can escape to the outside.

Figure 2:
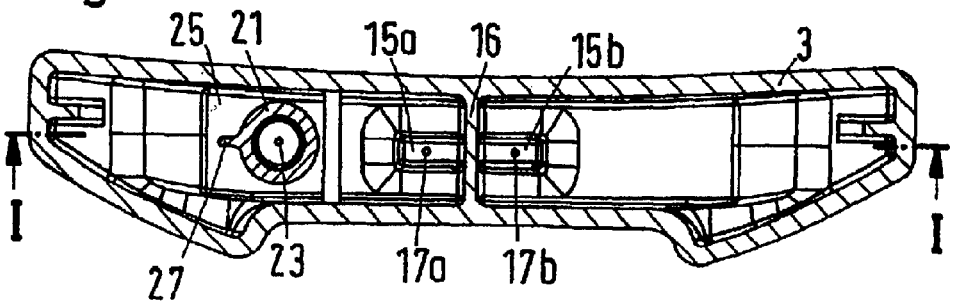
FIG. 2 is a section II—II according to FIG. 1.

The housing nozzle 14 has an oblong cross-section, that is, its extension parallel to the drawing level in FIG. 1 is substantially larger than its extension perpendicular to the drawing level. The separating wall 16, which connects the front and the reverse of the housing nozzle 14 with each other, gives the housing nozzle 14 an increased mechanical stability. With its upper end the separating wall 16 projects into the lower chamber 11. Its broad surface side is oriented so that it points towards the inlet opening 7.

The lower end of the housing nozzle 14 is surrounded by an oil reservoir, in which the oil can build up so high that it is at least as high as a bottom 20 of the housing nozzle 14, so that the oil discharge openings 17*a*, 17*b* are always filled with oil.

The oil collecting room 15*a*, 15*b* has a cross-section, which is substantially smaller than the cross-section of the lower chamber 11. Still, the cross-section has been chosen so large that the oil collecting room 15*a*, 15*b* presents practically no flow resistance to the passing oil. With the oil discharge openings 17*a*, 17*b*, it is different. They are relatively small, that is, their cross-sectional area corresponds to maximum 5% of the cross-sectional area of the oil collecting room 15*a*, 15*b*. This means that the oil flowing through the oil discharge openings 17*a*, 17*b* is somewhat throttled. However, the main purpose of reducing the size of the oil discharge openings 17*a*, 17*b*, is to prevent a propagation of acoustic waves from the lower chamber 11 to the environment of the housing 2, 3.

The insert 4 has a pipe-shaped insert nozzle 21, in which an oil collecting room 22 is arranged, which is connected with the upper chamber 10. The insert nozzle 21 projects into the lower chamber 11. The oil collecting room 22 is connected with the lowest spot of the upper chamber 10. At the lower end of the oil collecting room 22 is arranged an oil discharge opening 23, through which oil from the upper chamber 10 can flow into the lower chamber 11.

The lower part 3 has a wall 24, which, together with the other wall parts of the lower part, forms an oil reservoir 25, whose filling level is so high that the bottom 26 of the insert nozzle 21 is always submerged in the oil in the oil reservoir 25, so that the oil discharge opening 23 is permanently filled with oil.

During operation, a compressor (not shown in detail) sucks refrigerant gas through the inlet opening 7 and the channel 12 to the outlet opening 9. Acoustic waves, which are usually coupled back to the muffler 1, particularly by the compressor or its valve arrangement, are damped in the upper chamber 10 and the lower chamber 11, as known per se.

The refrigerant gas always contains a certain amount of oil. This oil is, at least partly, precipitated in the upper chamber 10 and the lower chamber 11. The oil that is precipitated in the upper chamber 10 gathers in the oil collecting room 22 in the insert nozzle 21. The oil collecting room 22 has a substantially smaller cross-sectional area than the upper chamber 10. Even small amounts of oil are sufficient to produce a fluid column. At its lower end, that is, at the oil discharge opening 23, this fluid column has a hydrostatic pressure, which is so large that it can overcome pressure differences between the upper chamber 10 and the lower chamber 11. Such a pressure difference results from the suction of refrigerant gas from the outlet opening 9.

The oil escaping through the oil discharge opening 23 reaches the reservoir 25 and the flows via the wall 24 into the oil collecting room 15*a*.

In a similar manner, the oil that is precipitated in the lower chamber 11 gathers in the oil collecting room 15*a*, 15*b*, where it produces a fluid column, whose hydrostatic pressure is sufficient to enable the oil from the oil collecting room 15*a*, 15*b* to escape through the oil discharge openings 17*a*, 17*b*, also when a negative pressure rules in the lower chamber 11.

The oil level in the oil collecting room 22 and the oil level in the oil collecting room 15 will adjust itself in dependence of the pressure differences between the upper chamber 10 and the lower chamber 11 or the lower chamber 11 and the environment, respectively.

The free oil surface of the oil in the oil collecting room 22 or the oil collecting room 15, respectively, is relatively small, so that refrigerant gas, which is led across this surface will only entrain very little or even no oil. As the pressure conditions ruling during operation are known, it can be ensured that the lengths of the housing nozzle 14 and the insert nozzle 21 are chosen so that the fluid column is never larger than the lengths of these two nozzles 14, 21.

When the compressor is turned off and stands still for a long period, oil can escape from the oil collecting rooms 22 and 15 to the outside due to the gravity. In order to prevent the oil discharge openings 23 or 17*a*, 17*b*, respectively, to be emptied under these circumstances, which would leave an open path between the upper chamber and the lower chamber or the lower chamber and the environment, respectively, through which acoustic waves could propagate unimpeded, the oil reservoirs 18, 25 are provided, with which it is ensured that the oil discharge openings 17*a*, 17*b*, 23 are always filled with oil. Also during a new start of the compressor, there is no risk that sound waves propagate to the outside through these oil discharge openings.

The insert nozzle 21 has a mechanically reinforcing rib 27, through which an oscillation excitation of the insert nozzle 21 through pressure pulses in the refrigerant gas is substantially avoided.

Figure 3:
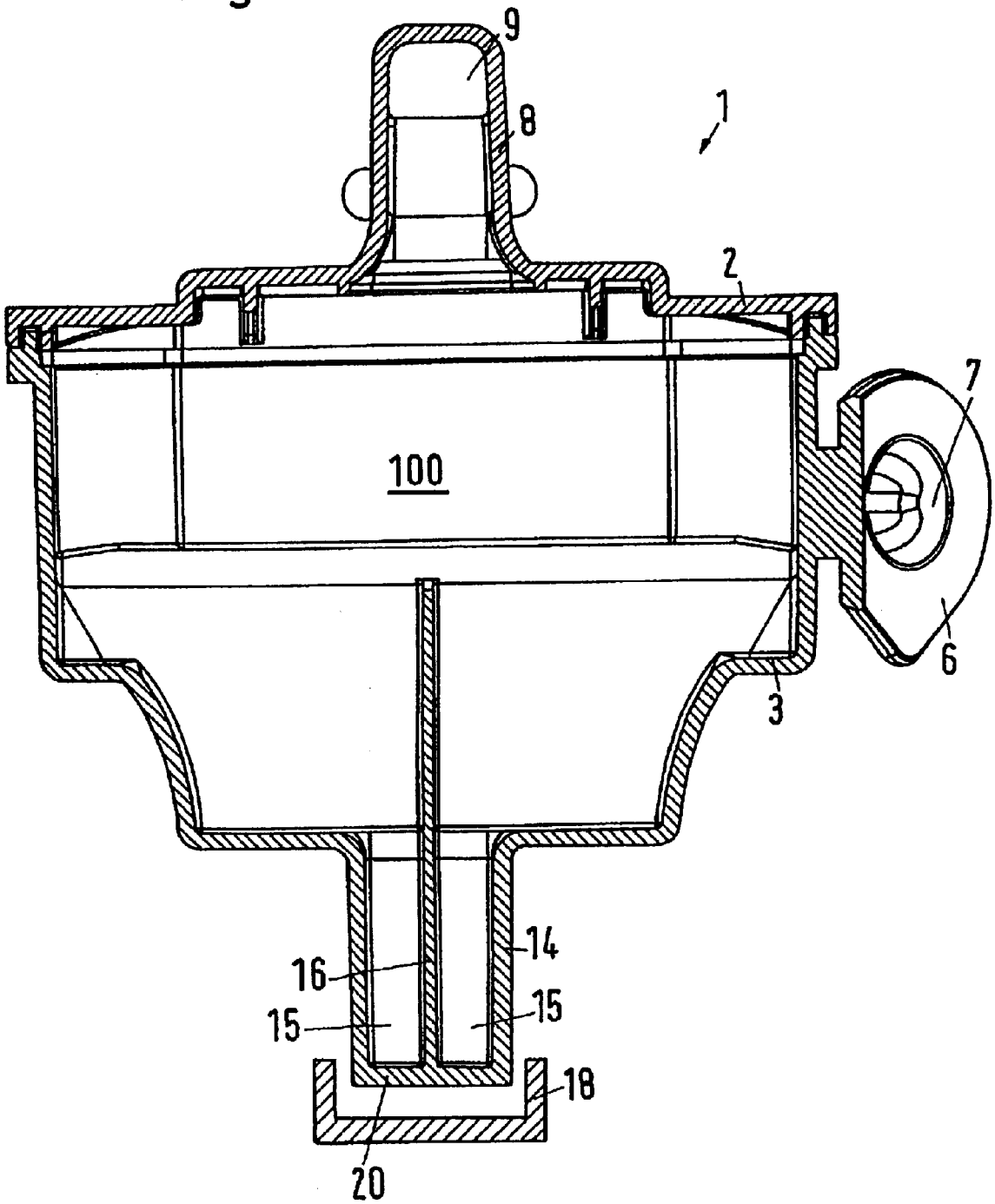
FIG. 3 is a longitudinal section of a second embodiment of a suction muffler.

FIG. 3 shows a suction muffler 1 without insert. Same parts are provided with the same reference numbers.

Also here a housing nozzle 14 extends from the bottom side of the lower part 3, so that here an oil collecting room 15 is formed, which is divided into two halves by the separating wall 16. The oil discharge openings 17 cannot be seen here, as they are not arranged in this sectional plane.

In both embodiments it is ensured that in spite of the existence of an oil collecting room 15, 22, the complete volume of the chamber 10, 11 or 100 (FIG. 3), respectively, is available for the muffling. The oil that gathers inside the suction muffler 1 thus causes practically no change to the muffling properties.

Figure 4:
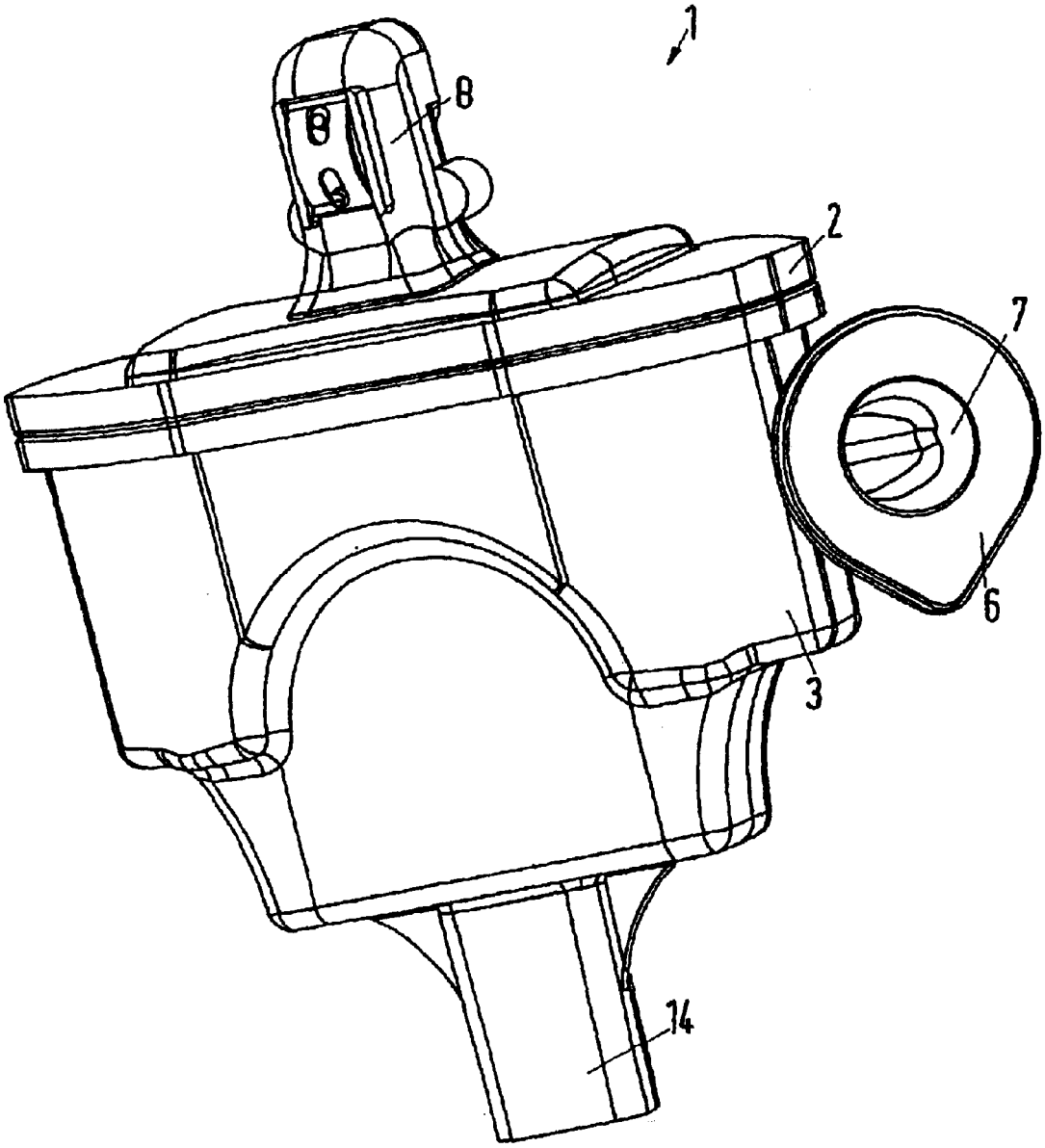
FIG. 4 shows the suction muffler according to FIG. 1 from the outside.

FIG. 4 shows the suction muffler 1 from the outside, so that it can be seen that the housing nozzle 14 has a flat embodiment.

What is claimed is:

1. A suction muffler for a refrigerating machine comprising:

a housing, having at least one chamber, the housing having an inlet opening, an outlet opening and an oil discharge opening, the housing including an oil collecting room connected with a base surface of the chamber, and the oil discharge opening being arranged at a bottom end of the oil collecting room between the oil collecting room and the outside of the housing, wherein the oil discharge opening discharges the oil to the outside of the housing.

2. A suction muffler for a refrigerating machine comprising:

a housing, having at least one chamber, the housing having an inlet opening, an outlet opening and an oil discharge opening, the housing including an oil collecting room connected with a base surface of the chamber, and the oil discharge opening being arranged at a bottom end of the oil collecting room, wherein the oil collecting room has a base surface, which is smaller than the base surface defined by the chamber.

3. A suction muffler according to claim 2, wherein the oil collecting room is arranged in a housing nozzle projecting from a bottom side of the housing.

4. A suction muffler according to claim 3, wherein the housing nozzle defines an oblong cross-section.

5. A suction muffler according to claim 1, wherein the oil discharge opening ends in an oil-filled area.

6. A suction muffler for a refrigerating machine comprising:

a housing, having at least one chamber, the housing having an inlet opening, an outlet opening and an oil discharge opening, the housing including an oil collecting room connected with a base surface of the chamber, and the oil discharge opening being arranged at a bottom end of the oil collecting room, wherein the oil discharge opening defines a throttling resistance, which is larger than a throttling resistance generated by the oil collecting room.

7. A suction muffler according to claim 6, wherein the cross-section defined by the oil discharge opening amounts to 5% or less of the base surface of the oil collecting room.

8. A suction muffler according to claim 1, further comprises an insert arranged in the housing, said insert dividing the chamber into an upper chamber and a lower chamber and having its own oil collecting room at a bottom end defined by the upper chamber, the oil discharge opening of said oil collecting room ending in the lower chamber.

9. A suction muffler for a refrigerating machine comprising:

a housing, having at least one chamber, the housing having an inlet opening, an outlet opening and an oil discharge opening, the housing including an oil collecting room connected with a base surface of the chamber, the oil discharge opening being arranged at a bottom end of the oil collecting room, and an insert arranged in the housing, said insert dividing the chamber into an upper chamber and a lower chamber and having its own oil collecting room at a bottom end defined by the upper chamber, the oil discharge opening of said oil collecting room ending in the lower chamber, wherein the insert has a pipe-like insert nozzle, in which the oil collecting room is arranged, and which extends into the lower chamber.

10. A suction muffler according to claim 9, wherein a bottom end of the insert nozzle is surrounded by an annular wall, which is connected with a bottom of the lower chamber.

11. A suction muffler according to claim 9, wherein the insert nozzle has at least one rib on an outer wall, said rib extending substantially in the longitudinal direction.

12. A suction muffler according to claim 2, further comprising a dividing wall arranged in the oil collecting room.

13. A suction muffler according to claim 12, wherein the dividing wall projects into the chamber.

* * * * *